US009337582B2

(12) United States Patent
Sato et al.

(10) Patent No.: US 9,337,582 B2
(45) Date of Patent: May 10, 2016

(54) CONNECTOR UNIT

(71) Applicant: Yazaki Corporation, Tokyo (JP)

(72) Inventors: Akira Sato, Shizuoka (JP); Kazuhide Takahashi, Shizuoka (JP); Tomonari Okamoto, Aichi (JP); Kazuhisa Nimura, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/339,546

(22) Filed: Jul. 24, 2014

(65) Prior Publication Data

US 2014/0335739 A1 Nov. 13, 2014

Related U.S. Application Data

(63) Continuation of application No. PCT/JP2013/052288, filed on Jan. 25, 2013.

(30) Foreign Application Priority Data

Jan. 25, 2012 (JP) ..... 2012-013034

(51) Int. Cl.
*H01R 13/641* (2006.01)
*H01R 13/645* (2006.01)
*H01R 13/629* (2006.01)

(52) U.S. Cl.
CPC ..... *H01R 13/641* (2013.01); *H01R 13/629* (2013.01); *H01R 13/6456* (2013.01)

(58) Field of Classification Search
CPC ..... H01R 13/64; H01R 16/6456
USPC ..... 439/680, 681
See application file for complete search history.

(56) References Cited

U.S. PATENT DOCUMENTS 3,008,116 A * 11/1961 Blanchenot ..... H01R 13/625 439/317
3,077,571 A * 2/1963 Curtis ..... H01R 13/64 439/680

(Continued)

FOREIGN PATENT DOCUMENTS

CN 101689728 A 3/2010
CN 101728717 A 6/2010

(Continued)

OTHER PUBLICATIONS

International Search Report and Written Opinion issued in International Patent Application No. PCT/JP2013/052288 dated Apr. 18, 2013.

(Continued)

*Primary Examiner* — Ross Gushi
(74) *Attorney, Agent, or Firm* — Morgan, Lewis & Bockius LLP

(57) ABSTRACT

A connector unit has a male connector that includes a cylindrical proximal portion in which a female terminal is accommodated, and a female connector that includes a tubular proximal portion in which a male terminal is held. The cylindrical proximal portion has a cylinder side marking portion including a flat surface formed on a part of an outer circumferential surface thereof, and a cylinder side rotation restricting portion including a groove portion or a projecting portion formed on the outer circumferential surface thereof. The tubular proximal portion has a tube side marking portion including a flat surface formed on an inner surface circumferential surface of the tubular proximal portion, and a tube side rotation restricting portion including a projecting portion projected from the inner circumferential surface or a groove portion formed in the inner circumferential surface.

2 Claims, 10 Drawing Sheets

(56) References Cited

U.S. PATENT DOCUMENTS 3,901,574 A * 8/1975 Paullus ..... H01R 13/623 285/401
3,986,765 A * 10/1976 Shaffer ..... H01R 13/625 439/314
4,059,324 A * 11/1977 Snyder ..... H01R 13/623 439/321
4,090,759 A * 5/1978 Herrmann, Jr. ..... H01R 13/53 439/279
4,229,064 A * 10/1980 Vetter ..... H01R 13/6456 439/680
4,284,312 A * 8/1981 Patchett ..... H01R 13/5219 439/281
4,289,368 A * 9/1981 Schildkraut ..... H01R 13/641 439/315
4,310,213 A * 1/1982 Fetterolf, Sr. ..... H01R 13/516 439/320
4,493,525 A * 1/1985 Hall ..... H01R 9/032 439/607.47
4,500,946 A * 2/1985 Mikola ..... F21S 48/1109 362/267
4,513,356 A * 4/1985 Mikola ..... F21S 48/1109 313/318.07
4,528,619 A * 7/1985 Dolan ..... F21S 48/1122 313/113
4,590,542 A * 5/1986 Schauwecker ..... F21S 48/1122 362/267
4,611,878 A * 9/1986 Hall ..... H01R 9/032 439/353
4,634,208 A * 1/1987 Hall ..... H01R 9/032 439/607.51
4,637,669 A * 1/1987 Tajima ..... H01R 23/6873 200/51.07
4,648,681 A * 3/1987 Pass ..... H01R 13/7197 29/854
4,679,128 A * 7/1987 Van Duyn ..... F21S 48/1113 362/306
4,737,124 A * 4/1988 Ezure ..... H01R 23/26 439/585
4,741,708 A * 5/1988 Yoshida ..... H01R 9/032 439/483
4,764,854 A * 8/1988 Matsune ..... F21S 48/1113 362/227
4,820,204 A * 4/1989 Batty ..... H01R 13/645 439/681
4,822,302 A * 4/1989 Dorleans ..... F21S 48/1122 362/655
4,842,554 A * 6/1989 Cosmos ..... H01R 23/6873 439/607.17
4,842,555 A * 6/1989 Cosmos ..... H01R 13/627 174/359
4,851,976 A * 7/1989 McMahan ..... F21S 48/1113 362/306
4,894,026 A * 1/1990 Dixon ..... H01R 13/65802 439/607.17
4,913,664 A * 4/1990 Dixon ..... H01R 13/65802 439/607.28
4,960,388 A * 10/1990 Frantz ..... H01R 13/648 439/404
4,960,389 A * 10/1990 Frantz ..... H01R 43/01 439/404
4,969,839 A * 11/1990 Nilsson ..... H01R 4/2429 439/395
4,983,127 A * 1/1991 Kawai ..... H01R 23/6873 439/79
5,007,862 A * 4/1991 Defibaugh ..... H01R 13/64 439/564
5,017,157 A * 5/1991 Liu ..... H01R 13/6584 439/353
5,022,871 A * 6/1991 Sekiguchi ..... H01R 23/6873 439/607.19
5,035,650 A * 7/1991 Defibaugh ..... H01R 13/65802 439/607.17
5,108,311 A * 4/1992 Nakazawa ..... H01R 13/629 439/607.32
5,120,268 A * 6/1992 Gerrans ..... H01R 13/523 439/278
5,127,843 A * 7/1992 Henry ..... H01R 13/6592 439/320
5,178,562 A * 1/1993 Ermini ..... H01R 13/65802 439/149
5,180,316 A * 1/1993 Miller ..... H01R 13/6592 439/247
5,273,443 A * 12/1993 Frantz ..... H01R 13/424 439/595
5,288,248 A * 2/1994 Chen ..... H01R 23/6873 439/108
5,417,585 A * 5/1995 Morin ..... H01R 13/465 439/488
5,622,523 A * 4/1997 Kan ..... H01R 13/6485 439/607.37
D381,628 S * 7/1997 Ashida ..... H01R 13/6485 D13/147
5,730,624 A * 3/1998 Lester ..... H01R 13/4365 439/595
5,908,331 A * 6/1999 Hsu ..... H01R 13/65802 439/607.28
5,913,698 A * 6/1999 Keng ..... H01R 13/65802 439/607.17
5,980,293 A * 11/1999 Nagano ..... H01R 13/641 439/315
6,227,904 B1 * 5/2001 Wang ..... H01R 13/65802 439/540.1
6,231,358 B1 * 5/2001 Kerr, Jr. ..... H01R 24/66 439/140
6,234,841 B1 * 5/2001 Chang ..... H01R 13/65802 439/607.25
6,336,822 B1 * 1/2002 Luzzoli ..... H01R 13/625 439/314
6,338,657 B1 * 1/2002 Harper ..... A61B 18/14 439/598
6,343,941 B1 * 2/2002 Kan ..... H01R 13/65802 439/95
6,361,349 B1 * 3/2002 Hung ..... H01R 13/53 439/345
6,482,045 B2 * 11/2002 Arai ..... H01R 13/6456 439/680
6,508,669 B2 * 1/2003 Wang ..... H01R 13/59 439/353
6,764,338 B2 * 7/2004 Fang ..... H01R 12/721 439/607.2
6,811,423 B2 * 11/2004 Yoshigi ..... H01R 13/641 439/315
6,824,403 B2 * 11/2004 Hall ..... H01R 24/50 439/101
6,942,516 B2 * 9/2005 Shimoyama ..... H01R 13/6272 439/352
6,957,971 B2 * 10/2005 Wu ..... H01R 13/5213 439/320
7,008,266 B2 * 3/2006 Fang ..... H01R 12/721 439/607.35
7,052,282 B2 * 5/2006 Meleck ..... H01R 13/6271 439/163
7,077,677 B2 * 7/2006 Sanuki ..... H01R 13/623 439/315
7,137,839 B2 * 11/2006 Dilliner ..... H01R 24/28 439/315
7,192,198 B1 * 3/2007 Chen ..... G02B 6/32 385/76
7,333,391 B2 * 2/2008 Chamberlain ..... G01V 1/201 367/20
7,470,154 B2 * 12/2008 Sato ..... H01R 13/03 439/693
7,510,430 B2 * 3/2009 Zhang ..... H01R 12/58 439/541.5
7,604,505 B2 * 10/2009 Zayas ..... H01J 5/54 439/236
7,661,991 B1 * 2/2010 Sun ..... H01R 12/58 439/607.55
7,661,995 B2 * 2/2010 Nania ..... H01R 13/6599 439/681
7,666,028 B2 * 2/2010 Meleck ..... H01R 13/6272 439/502

(56) References Cited

U.S. PATENT DOCUMENTS

| | | | | |
|---|---|---|---|---|
| 7,674,137 | B2 * | 3/2010 | Sato | H01R 13/03 439/693 |
| 7,699,640 | B2 * | 4/2010 | Brekosky | H01R 13/65802 439/101 |
| 7,726,994 | B1 | 6/2010 | Willey | |
| 7,927,108 | B2 * | 4/2011 | Gong | H01R 13/7031 439/63 |
| D638,800 | S * | 5/2011 | The | H01R 13/6485 D13/154 |
| 7,938,689 | B2 * | 5/2011 | Isaac | H01R 13/64 439/247 |
| 7,980,886 | B2 * | 7/2011 | Liu | H01R 13/465 439/488 |
| 8,192,216 | B1 * | 6/2012 | Puluc | H01R 13/5219 439/271 |
| 8,747,166 | B2 * | 6/2014 | Yamada | H01R 13/64 439/680 |
| 8,968,036 | B2 * | 3/2015 | Ledgerwood | H01R 13/641 439/677 |
| 8,979,559 | B2 * | 3/2015 | Aldrich | H01R 13/516 439/133 |
| 2002/0072275 | A1 * | 6/2002 | Arai | H01R 13/6456 439/680 |
| 2003/0100213 | A1 | 5/2003 | Yoshigi et al. | |
| 2004/0132347 | A1 * | 7/2004 | Souvay | H01R 13/622 439/681 |
| 2005/0075000 | A1 | 4/2005 | Wu | |
| 2005/0136723 | A1 * | 6/2005 | Dilliner | H01R 24/28 439/320 |
| 2005/0186825 | A1 * | 8/2005 | Yen | H01R 33/7614 439/336 |
| 2006/0025021 | A1 * | 2/2006 | Ishizaki | H01R 24/542 439/677 |
| 2006/0046579 | A1 * | 3/2006 | Karadimas | H01R 13/6456 439/680 |
| 2006/0051999 | A1 * | 3/2006 | Allemann | H01R 13/622 439/320 |
| 2006/0257076 | A1 * | 11/2006 | Seeley | G02B 6/3831 385/60 |
| 2008/0233773 | A1 * | 9/2008 | Meleck | H01R 13/64 439/107 |
| 2008/0248674 | A1 * | 10/2008 | Wehrle | H01R 13/622 439/321 |
| 2010/0104355 | A1 | 4/2010 | Sugimoto et al. | |
| 2010/0178788 | A1 * | 7/2010 | Collin | H01R 13/62966 439/317 |
| 2010/0240242 | A1 | 9/2010 | Pfaffenbach | |
| 2014/0335739 | A1 * | 11/2014 | Sato | H01R 13/6456 439/680 |

FOREIGN PATENT DOCUMENTS

| | | | |
|---|---|---|---|
| CN | 102301538 | A | 12/2011 |
| DE | 19506713 | A1 | 8/1996 |
| DE | 202005014281 | U1 | 1/2007 |
| JP | 59-170382 | | 11/1984 |
| JP | 2003-163056 | A | 6/2003 |

OTHER PUBLICATIONS

International Preliminary Report on Patentability dated Jul. 29, 2014 and Written Opinion for International application No. PCT/JP2013/052288.

The First Office Action dated Nov. 26, 2015 from The State Intellectual Property Office of People's Republic of China in counterpart Chinese application No. 201380006737.8.

Notification of Reason for Refusal dated Oct. 8, 2015 from the KIPO in counterpart Korean application No. 10-2014-702061.

Notification of Reasons for Refusal dated Sep. 4, 2015 from the JP Patent Office in counterpart JP application No. 2012-013034.

Office Action dated Nov. 4, 2015 from the Japanese Patent Office in counterpart Japanese application No. 2012-013034.

* cited by examiner

CONNECTOR UNIT

CROSS REFERENCE TO RELATED APPLICATIONS

This application is a continuation of PCT application No. PCT/JP2013/052288, which was filed on Jan. 25, 2013 based on Japanese Patent Application (No. 2012-013034) filed on Jan. 25, 2012, the contents of which are incorporated herein by reference.

BACKGROUND OF THE INVENTION

1. Field of the Invention

The present invention relates to a connector unit in which female terminals and male terminals are connected by fitting a male connector and a female connector together.

2. Description of the Related Art

Conventionally, there are connector units that have a male connector holding female terminals and a female connector holding male terminals and in which the female terminals and the male terminals are connected together by fitting the male connector in the female connector. In some of these connector units, the male connector accommodates the female terminals in a cylindrical proximal portion, and the female connector holds the male terminals in a tubular proximal portion. Then, the cylindrical proximal portion is fitted in a tubular interior of the tubular proximal portion, whereby the female terminals and the male terminals are connected together (for example, refer to JP-A-2003-163056).

In a connector unit described in JP-A-2003-163056, grooves are provided at predetermined intervals on an outer circumferential surface of the male connector. Then, when the male connector is fitted in the female connector, corresponding positioning portions which are provided on an inner wall of a female connector housing are inserted into the grooves, whereby the male connector and the female connector are positioned relative to each other.

SUMMARY OF THE INVENTION

In the connector unit described in JP-A-2003-163056, however, the grooves are disposed circumferentially on the outer circumferential surface of the male connector in a dispersed fashion, and therefore, it is difficult to recognize the assembling direction of the male connector to the female connector for a user by using the grooves as markings. When the male connector and the female connector are assembled together in such a state that the connectors are not aligned properly in the assembling direction, the male terminals are brought into abutment with the cylindrical proximal portion of the male connector, resulting in fears that the male terminals are damaged.

The disclosure has been made in view of these situations, and an object thereof is to provide a connector unit which can prevent the damage of terminals when a male connector is fitted in a female connector.

With a view to attaining the object by solving the problem, according to a first aspect of the disclosure, there is provided a connector unit comprising:

a male connector that includes a cylindrical proximal portion in which a female terminal is accommodated; and a female connector that includes a tubular proximal portion in which a male terminal is held, wherein the female terminal and the male terminal are connected together when the cylindrical proximal portion is fitted in the tubular proximal portion;

wherein the cylindrical proximal portion has:

a cylinder side marking portion including a flat surface which is formed on a part of an outer circumferential surface of the cylindrical proximal portion, the flat surface is perpendicular to a radial direction of the cylindrical proximal portion; and a cylinder side rotation restricting portion including a groove portion or a projecting portion formed on the outer circumferential surface of the cylindrical proximal portion; and wherein the tubular proximal portion has:

a tube side marking portion including a flat surface which is formed on an inner surface circumferential surface of the tubular proximal portion so as to corresponds to the flat surface of the cylinder side marking portion; and a tube side rotation restricting portion including a projecting portion which is projected from the inner circumferential surface so as to fit in the groove portion of the cylinder side rotation restricting portion or a groove portion which is formed in the inner circumferential surface so that the projecting portion of the cylinder side rotation restricting portion is fitted therein.

In addition, according to a second aspect of the disclosure, in the connector unit, the groove portion of the tube side rotation restricting portion is formed in the flat surface of the tube side marking portion, and the projecting portion of the cylinder side rotation restricting portion is formed on the flat surface of the cylinder side marking portion.

Additionally, according to a third aspect of the disclosure, in the connector unit, the cylindrical proximal portion further has other cylinder side rotation restricting portion, and the cylinder side rotation restricting portion and the other cylinder side rotation restricting portion are provided individually in a plurality of locations on the outer circumferential surface. The tubular proximal portion further has other tube side rotation restricting portion, and the tube side rotation restricting portion and the other tube side rotation restricting portion are provided individually in a plurality of locations on the inner circumferential surface so as to fit in the cylinder side rotation restricting portion and the other cylinder side rotation restricting portion respectively. The other cylinder side rotation restricting portion includes a groove portion or a projecting portion formed on the outer circumferential surface of the cylindrical proximal portion. The other tube side rotation restricting portion includes a projecting portion which is projected from the inner circumferential surface so as to fit in the groove portion of the other cylinder side rotation restricting portion or a groove portion which is formed in the inner circumferential surface so that the projecting portion of the other cylinder side rotation restricting portion is fitted therein.

In the connector unit according to the first aspect of the disclosure, when the male connector and the female connector are fitted together, after the male connector and the female connector are properly aligned in the assembling direction using the cylinder side marking portion and the tube side marking portion as markings, the cylinder side rotation restricting portion and the tube side rotation restricting portion are fitted together. Namely, the male connector and the female connector are fitted together in such a state that the fitting position of the cylinder side rotation restricting portion and the tube side rotation restricting portion is determined, and therefore, the male connector and the female connector are prevented from rotating relatively on their axes, thereby making it possible to prevent the abutment of the male terminal with the cylindrical proximal portion. Thus, it is possible to prevent the damage of the terminal when the male connector and the female connector are fitted together.

In the connector unit according to the second aspect of the disclosure, the tube side rotation restricting portion is the groove portion which is formed by making use of a thickened portion of the flat surface by the tube side marking portion, and therefore, it is possible to utilize the space in an effective fashion.

In the connector unit according to the third aspect of the disclosure, the cylinder side rotation restricting portions and the tube side rotation restricting portions are each provided in the plurality of locations, and therefore, it can be made more difficult that the male connector and the female connector rotate relatively.

DETAILED DESCRIPTION OF THE EXEMPLARY EMBODIMENTS

Hereinafter, a preferred embodiment of a connector unit according to the disclosure will be described in detail by reference to the drawings.

Figure 1:
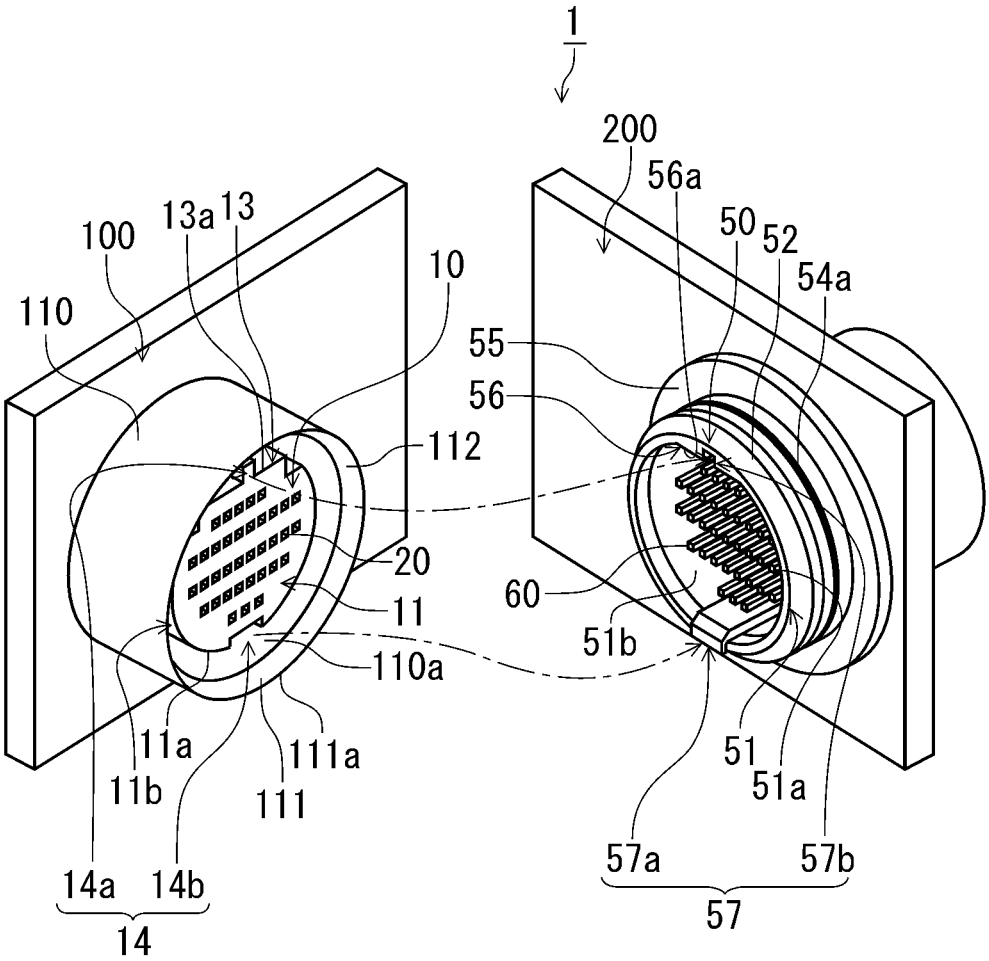
FIG. 1 is a perspective view depicting a state resulting before a male connector and a female connector of a connector unit according to an embodiment of the disclosure are fitted together.
Figure 2:
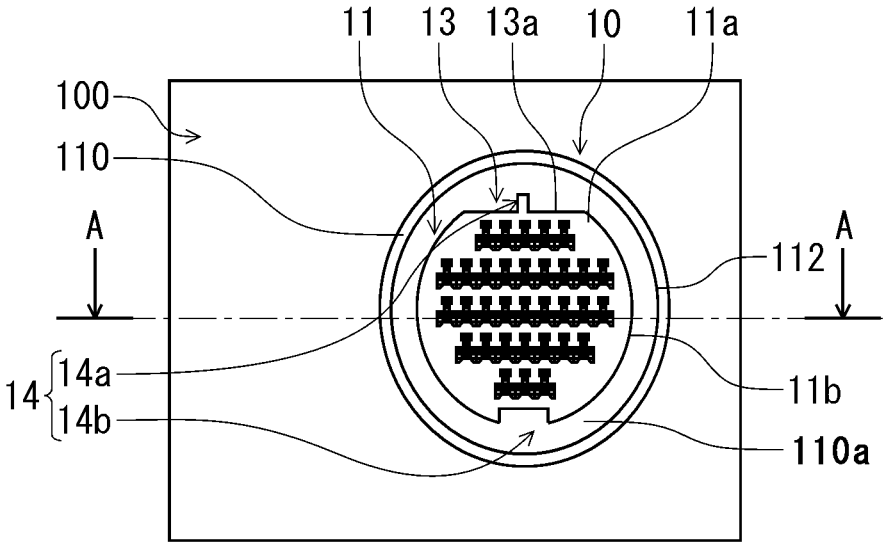
FIG. 2 is a view of the male connector depicted in FIG. 1 as seen from a direction in which the male connector is fitted.
Figure 3:
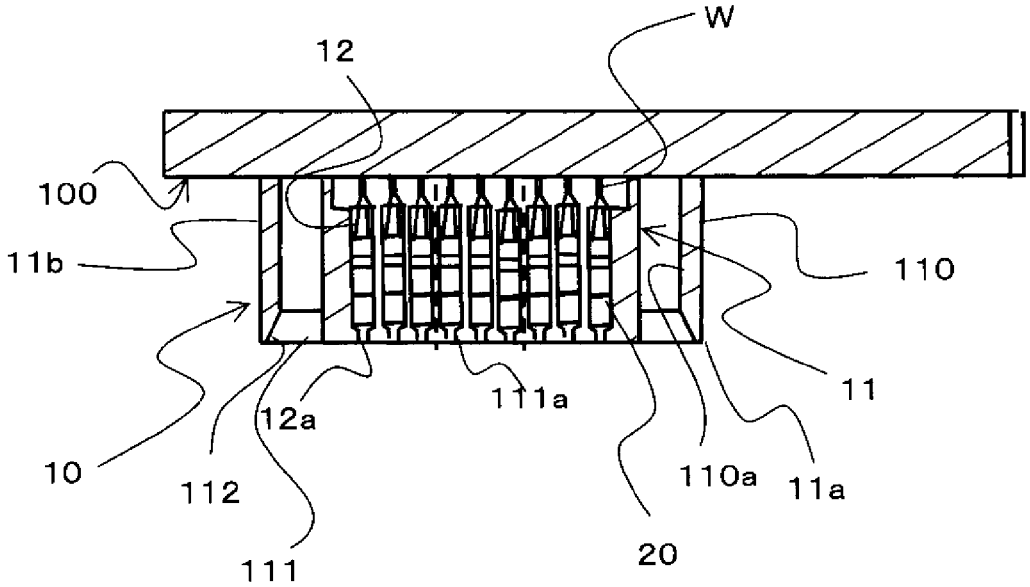
FIG. 3 is a sectional view of the male connector taken along the line A-A in FIG. 2.
Figure 4:
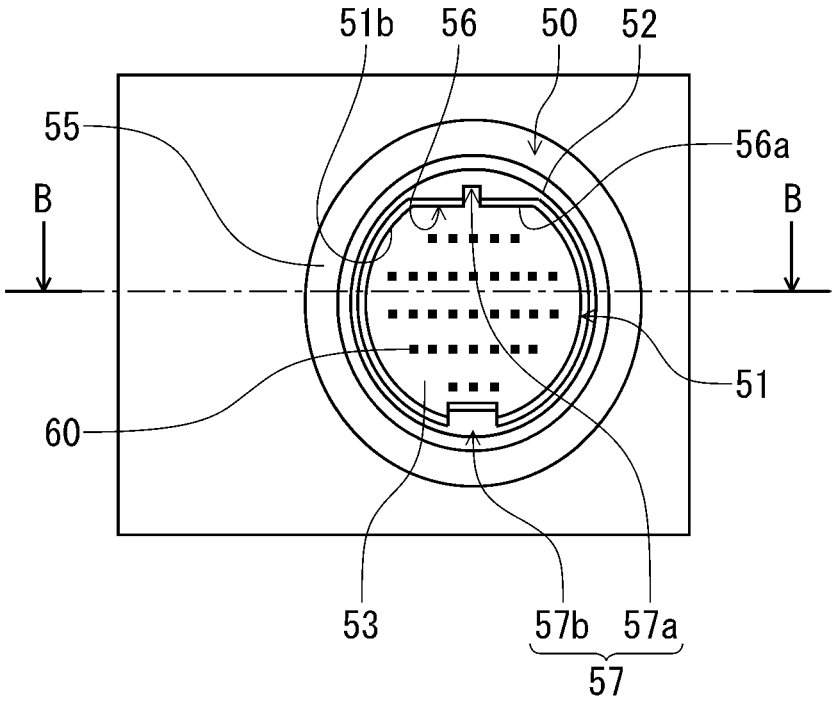
FIG. 4 is a view of the female connector depicted in FIG. 1 as seen from a direction in which the female connector is fitted.
Figure 5:
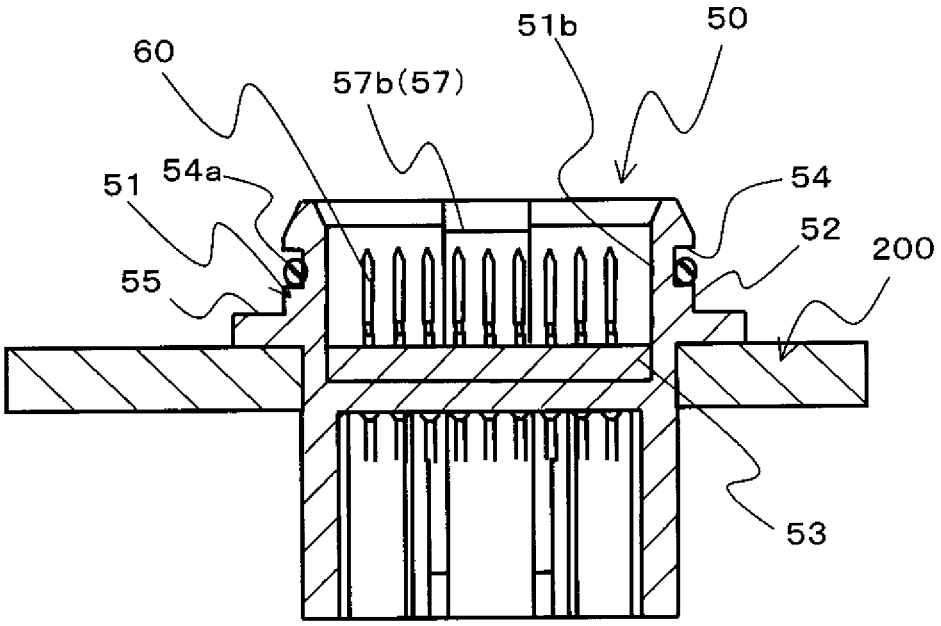
FIG. 5 is a sectional view of the female connector taken along the line B-B in FIG. 4.
Figure 6:
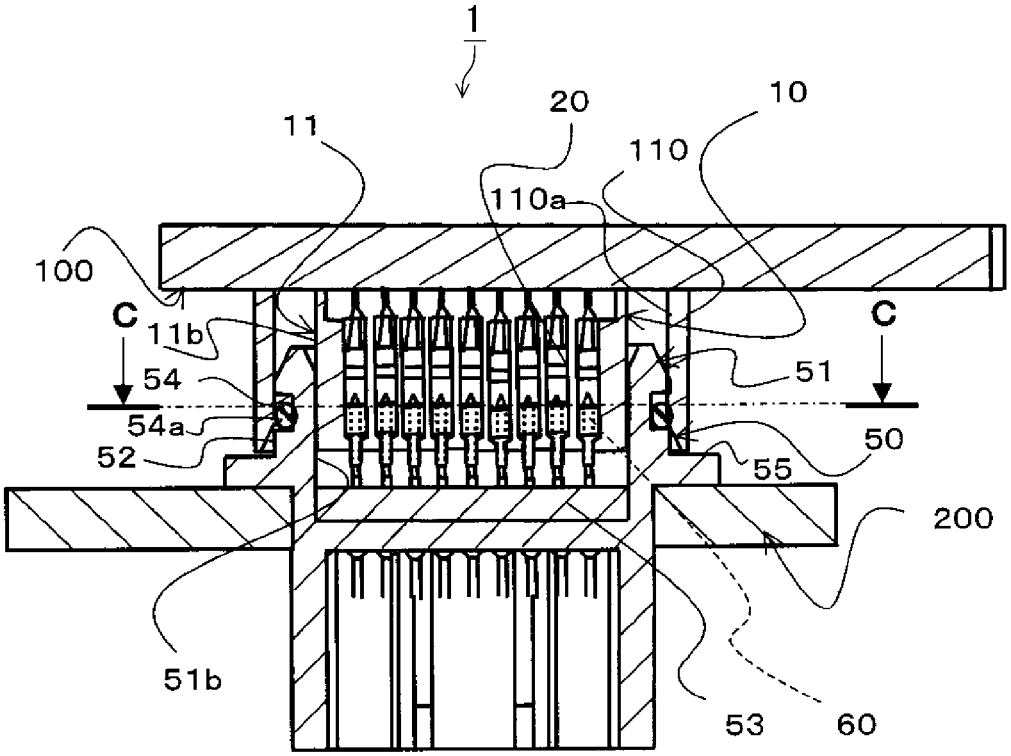
FIG. 6 is a sectional view of a main part of the connector unit depicted in FIG. 1 depicting a state in which the male connector and the female connector are fitted together.
Figure 7:
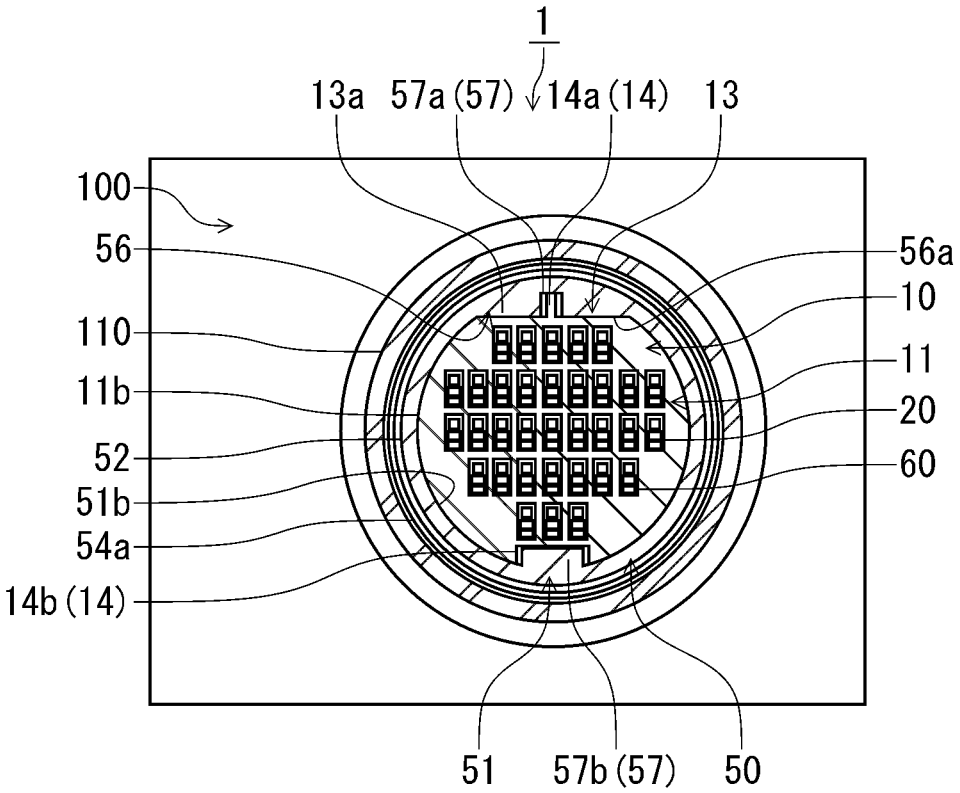
FIG. 7 is a sectional view of the connector unit taken along the line C-C in FIG. 6.
Figure 8:
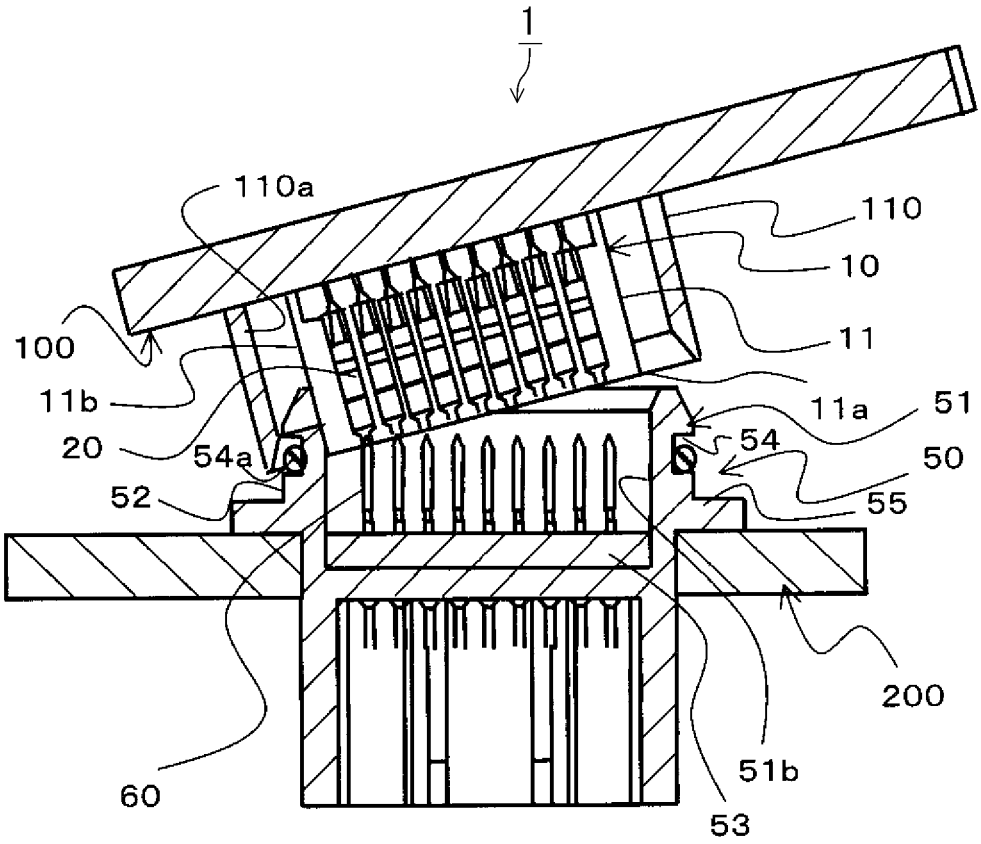
FIG. 8 is a diagram depicting a state in which the male connector and the female connector are halfway fitted together.
Figure 9:
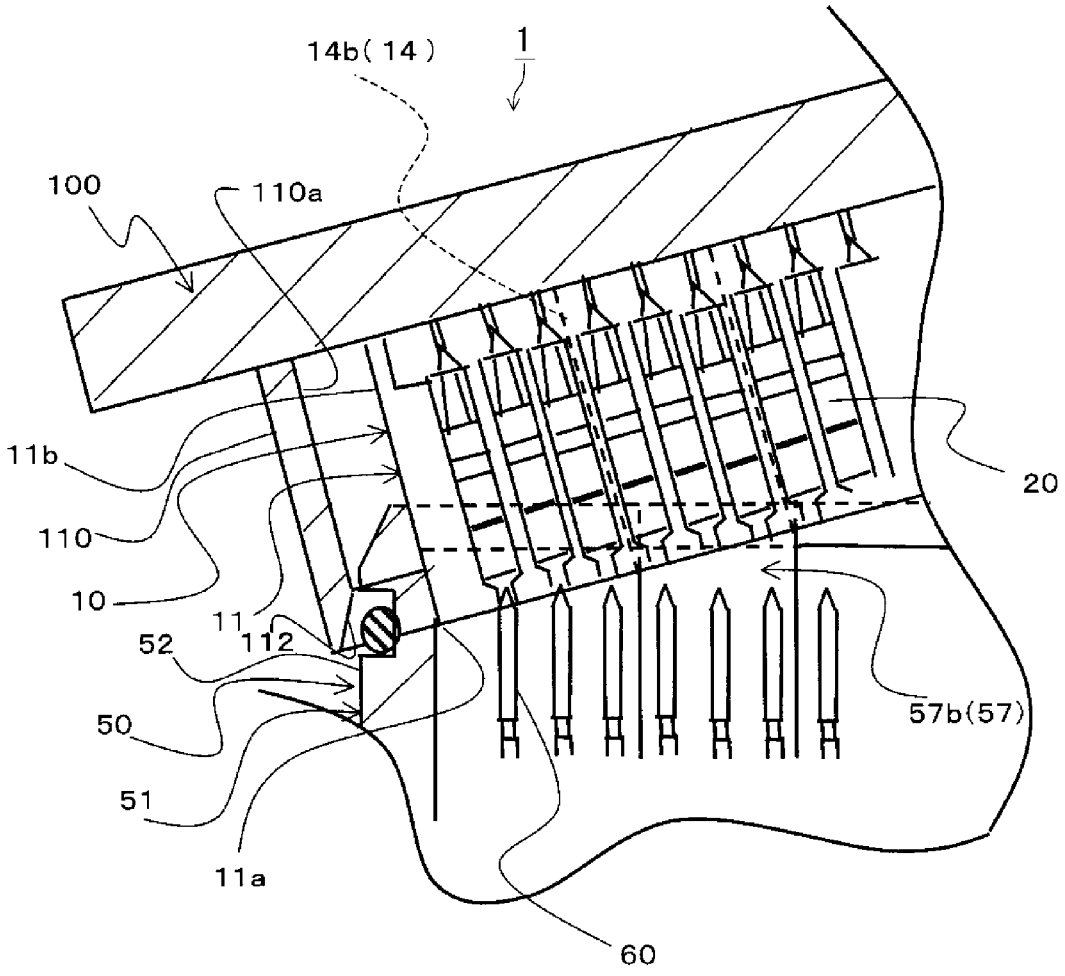
FIG. 9 is an enlarged view of a main part of the male connector and the female connector shown in FIG. 8.

FIG. 1 is a perspective view depicting a state resulting before a male connector 10 and a female connector 50 of a connector unit 1 according to an embodiment of the disclosure are fitted together. FIG. 2 is a view of the male connector 10 depicted in FIG. 1 as seen from a direction in which the male connector 10 is fitted. FIG. 3 is a sectional view of the male connector 10 taken along the line A-A in FIG. 2. FIG. 4 is a view of the female connector 50 depicted in FIG. 1 as seen from a direction in which the female connector 50 is fitted. FIG. 5 is a sectional view of the female connector 50 taken along the line B-B in FIG. 4. FIG. 6 is a sectional view of a main part of the connector unit 1 depicted in FIG. 1 depicting a state in which the male connector 10 and the female connector 50 are fitted together. FIG. 7 is a sectional view of the connector unit 1 taken along the line C-C in FIG. 6. FIG. 8 is a diagram depicting a state in which the male connector 10 and the female connector 50 are halfway fitted together. FIG. 9 is an enlarged view of a main part of the male connector 10 and the female connector 50 shown in FIG. 8.

A connector unit 1 according to the embodiment of the disclosure has, for example, a male connector 10 which is mounted on an ECU case which accommodates an ECU (Electronic Control Unit), not shown, which controls onboard electric and electronic components and a female connector 50 which is mounted on an A/T case 200 which is a case of an automotive automatic transmission. In this connector unit 1, female terminals 20 are accommodated in the male connector 10, and male terminals 60 are held in the female connector 50. Then, the male connector 10 is fitted in the female connector 50, whereby the female terminals 20 and the male terminals 60 are connected together.

Firstly, the male connector 10 will be described.

A plurality of female connectors 20 are accommodated in a cylindrical proximal portion 11 of the male connector 10, and the male connector 10 is attached directly to a circuit board, not shown, which is mounted in an ECU case 100.

The ECU case 100 has a hood portion 110. An inside diameter of the hood portion 110 is formed slightly larger than an outside diameter of a portion of a tubular proximal portion 51, which will be described later, of the female connector 50 in which the male connector 10 is fitted, and the cylindrical proximal portion 51 is disposed in a tubular interior of the hood portion 110.

When the male connector 10 and the female connector 50 are fitted together, the hood portion 110 surrounds an outer circumferential surface 52 of the tubular proximal portion 51, which will be described later, of the female connector 50, whereby connecting portions of male terminals 60 in the tubular proximal portion 51 with the female terminals 20 are surrounded in a waterproof fashion.

Additionally, an inclined taper portion 112 is formed at an opening edge portion 111 of the hood portion 110 so that the inside diameter of the hood portion 110 is increased in an axial direction from a deeper position towards an edge 111*a* of the opening edge portion 111. The tubular proximal portion 51 of the female connector 50 is brought smoothly into sliding contact with this taper portion 112, so that the tubular proximal portion 51 is inserted into the hood portion 110.

As shown in FIG. 3, the cylindrical proximal portion 11 has a plurality of female terminal 20 accommodation chambers 12 where the plurality of female terminals 20 are accommodated individually. Each female terminal accommodation chamber 12 is a chamber having a through hole which penetrates the chamber in an axial direction of the cylindrical proximal portion 11, and the female terminal 20 is held in a predetermined position within the chamber by a locking portion, not shown. Each female terminal 20 is disposed within the female terminal accommodation chamber 12 so that a connecting portion with the corresponding male terminal 60 is directed towards one opening 12*a* of openings of the chamber 12.

Additionally, the cylindrical proximal portion 11 has a cylinder side marking portion 13 and a cylinder side rotation restricting portion 14.

The cylinder side marking portion 13 has a flat surface 13*a* which is formed on an outer circumferential surface 11*b* thereof in such a way that the flat surface 11*b* intersects a radial direction of the cylindrical proximal portion 11 at right angles so that one portion of an outer circumferential edge 11*a* of the cylindrical proximal portion 11 becomes linear and lies as close to the female terminals 20 as possible. Namely, the cylinder side marking portion 13 is formed so that the flat surface 13*a* extends as wide as possible.

By doing so, the cylinder side marking portion 13 functions as a marking by which an assembling direction of the male connector 10 to the female connector 50 is recognized.

Additionally, the flat surface 13*a* extends from an edge of the cylindrical proximal portion 11 towards the ECU case 100 along the axial direction of the cylindrical proximal portion 11.

The cylinder side rotation restricting portion 14 is intended to prevent the relative rotation of the male connector 10 and the female connector 50 on their axes by being fitted together with a tube side rotation restricting portion 57, which will be described later. This cylinder side rotation restricting portion 14 has a projecting portion 14*a* which functions as a first cylinder side rotation restricting portion and a groove portion 14*b* which functions as a second cylinder side rotation restricting portion.

The projecting portion 14*a* is projected from the flat surface 13*a* of the cylinder side marking portion 13 and is intended to prevent the relative rotation of the male connector 10 and the female connector 50 on their axes by being fitted in a groove portion 57*a* which functions as a first tube side rotation restricting portion, which will be described later.

This projecting portion 14*a* has a substantially rectangular cross section and extends from the edge of the cylindrical proximal portion 11 towards the ECU case 100 along the axial direction of the cylindrical proximal portion 11.

Additionally, a distance from the axis or a radial center to the outer circumferential surface 11*b* of the cylindrical proximal portion 11 is made shorter as a result of the cylinder side marking portion 13 being formed, and the projecting portion 14*a* is formed by making use of the portion of the cylindrical proximal portion 11 where a gap between the outer circumferential surface 11*b* and the hood portion 110 is increased. Namely, the gap between the outer circumferential surface 11*b* and the hood portion 110 is increased by providing the cylinder side marking portion 13 on the outer circumferential surface 11*b*. Thus, the projecting portion 14*a* is formed in the gap which is increased, whereby the void space (the gap) is used effectively.

The groove portion 14*b* is formed in a portion of the outer circumferential surface 11*b* other than a portion where the cylinder side marking portion 13 is formed, and as a result of a projecting portion 57*b* which functions as a second tube side rotation restricting portion, which will be described later, being fitted in the groove portion 14*b*, the relative rotation of the made connector 10 and the female connector 50 on their axes is prevented.

This groove portion 14*b* is depressed into a shape having a substantially rectangular section and extends from the edge of the cylindrical proximal portion 11 towards the ECU case 100 along the axial direction of the cylindrical proximal portion 11.

Next, the female connector 50 will be described.

The female connector 50 has a plurality of male terminals 60 which are held in the tubular proximal portion 51 of which an inside diameter of a tubular interior is formed slightly larger than an external shape of the cylindrical proximal portion 11. The male terminals 60 are held individually by holding portions 53 provided in the tubular interior, and connecting portions of the male terminals 60 with electric wires, not shown, are sealed up by, for example, a resin, not shown, in a waterproof fashion.

Additionally, the tubular proximal portion 51 has a seal member disposing portion 54 and a flange portion 55.

The seal member disposing portion 54 is a groove which is formed along a circumferential direction on an outer circumferential surface 52 of a portion of the tubular proximal portion 51 which is exposed to the outside of the A/T case 200 and constitutes a portion where an annular elastic seal member 54*a* such as an O ring is mounted. A gap between the outer circumferential surface 52 of the tubular proximal portion 51 and an inner circumferential surface 110*a* of the hood portion 110 of the ECU case 100 is sealed up by the annular elastic seal member 54*a* so as to prevent the entrance of water from an outer portion of the A/T case 200.

The flange portion 55 constitutes a portion which is fixed to the A/T case 200 when the female connector 50 is mounted on the A/T case 200. This flange portion 55 is formed so as to project along a circumferential direction of the outer circumferential surface 52 of the tubular proximal portion 51.

Additionally, the tubular proximal portion 51 has a tube side marking portion 56 and the tube side rotation restricting portion 57.

The tube side marking portion 56 is a portion where an inner circumferential surface 51*b* of the tubular proximal portion 51 is thickened so that a flat surface 56*a* is formed so as to face oppositely the flat surface 13*a* of the cylinder side marking portion 13.

In this tube side marking portion 56, the flat surface 56*a* is formed on the inner circumferential surface 51*b* in such a way that the flat surface 56*a* intersects a radial direction of the tubular proximal portion 51 at right angles so that one portion of an inner circumferential edge 51*a* of the tubular proximal portion 51 becomes linear and lies as close to the male terminals 60 as possible. Namely, the tube side marking portion 56 is formed so that the flat surface 56*a* spreads as wide as possible.

By doing so, the tube side marking portion 56 functions as a marking by which the assembling direction of the male connector 10 to the female connector 50 is recognized.

The tube side rotation restricting portion 57 is fitted together with the cylinder side rotation restricting portion 14 to thereby prevent the relative rotation of the male connector 10 and the female connector 50 on their axes. This tube side rotation restricting portion 57 has the groove portion 57*a* which functions as the first tube side rotation restricting portion and the projecting portion 57*b* which functions as the second tube side rotation restricting portion.

The groove portion 57*a* is formed on the flat surface 56*a* of the tube side marking portion 56. The groove portion 57*a* fits on the projecting portion 14*a* which functions as the first cylinder side rotation restricting portion to thereby prevent the relative rotation of the male connector 10 and the female connector 50 on their axes.

This groove portion 57*a* is formed by making use of the portion of the tubular proximal portion 51 which is thickened by the tube side marking portion 56. Namely, the groove portion 57*a* is formed at the portion of the tubular proximal portion 51 which is thickened by the tube side marking portion 56, whereby the space is utilized effectively.

In addition, the groove portion 57*a* is depressed into a shape having a substantially rectangular cross section and extends from an edge of the tubular proximal portion 51 towards the A/T case 200 along the axial direction.

The projecting portion 57*b* is a projection which is formed on a portion of the inner circumferential surface 51*b* other than the portion where the tube side marking portion 56 is formed. The projecting portion 57*b* fits in the groove portion 14*b* which functions as the second cylinder side rotation restricting portion to thereby prevent the relative rotation of the male connector 10 and the female connector 50 on their axes.

This projecting portion 57*b* has a substantially rectangular cross section and extends from the edge of the tubular proximal portion 51 towards the A/T case 200 along the axial direction.

In the male connector 10 and the female connector 50, the cylinder side rotation restricting portion 14 and the tube side rotation restricting portion 57 are fitted together after the male connector 10 and the female connector 50 are aligned properly in the assembling direction.

Because of this, when the male connector 10 and the female connector 50 are fitted together, as shown in FIGS. 8 and 9, the cylinder side rotation restricting portion 14 and the tube side rotation restricting portion 57 are fitted together in such a state that the fitting position of the cylinder side rotation restricting portion 14 and the tube side rotation restricting portion 57 is determined.

In the connector unit 1 according to the embodiment of the disclosure, when the male connector 10 and the female connector 50 are fitted together, the cylinder side rotation restricting portion 14 and the tube side rotation restricting portion 57 are fitted together after the male connector 10 and the female connector 50 are aligned properly in the assembling direction by using the cylinder side marking portion 13 and the tube side marking portion 56 as markings. Namely, since the male connector 10 and the female connector 50 are fitted together after the fitting position of the cylinder side rotation restricting portion 14 and the tube side rotation restricting portion 57 is determined, the relative rotation of the male connector 10 and the female connector 50 on their axes is prevented, whereby the abutment of the male terminals 60 with the cylindrical proximal portion 11 can be prevented, thereby making it possible to prevent the damage of the terminals when the male connector 10 and the female connector 50 are fitted together.

In addition, in the connector unit 1 according to the embodiment of the disclosure, since the groove portion 57*a* is formed by making use of the portion where the tubular proximal portion 51 is thickened by the tube side marking portion 56, the thickened portion which is produced by the provision of the tube side marking portion 56 can be used effectively.

Additionally, in the connector unit 1 according to the embodiment of the disclosure, the male connector 10 has the projecting portion 14*a* which functions as the first cylinder side rotation restricting portion and the groove portion 14*b* which functions as the second cylinder side rotation restricting portion, and the female connector 50 has the groove portion 57*a* which functions as the first tube side rotation restricting portion and the projecting portion 57*b* which functions as the second tube side rotation restricting portion. Namely, the cylinder side rotation restricting portion 14 is provided in the two locations and the tube side rotation restricting portion 57 is also provided in the two locations. Therefore, the relative rotation of the male connector 10 and the female connector 50 can be made more difficult to occur.

In the embodiment of the disclosure, while the connector unit 1 is described as including the projecting portion 14*a* which is provided as the first cylinder side rotation restricting portion, the groove portion 14*b* which is provided as the second cylinder side rotation restricting portion, the groove portion 57*a* which is provided as the first tube side rotation restricting portion and the projecting portion 57*b* which is provided as the second tube side rotation restricting portion, the disclosure is not limited to this configuration. Namely, the cylinder side rotation restricting portion 14 and the tube side rotation restricting portion 57 may be fitted together by means of the projecting portion and the groove portion. For example, a projecting portion may be provided as a second cylinder side rotation restricting portion and a groove portion in which the projecting portion fits may be provided as a second tube side rotation restricting portion.

Additionally, in the embodiment of the disclosure, while the connector unit 1 is described as having the cylinder side rotation restricting portion 14 which is provided in the two locations and the tube side rotation restricting portion 57 which is also provided in the two locations, the disclosure is not limited to the configuration in which the cylinder side rotation restricting portion 14 and the tube side rotation restricting portion 57 are each provided in the two locations. Namely, the cylinder side rotation restricting portion 14 and the tube side rotation restricting portion 57 should each be provided in at least one location.

Figure 10:
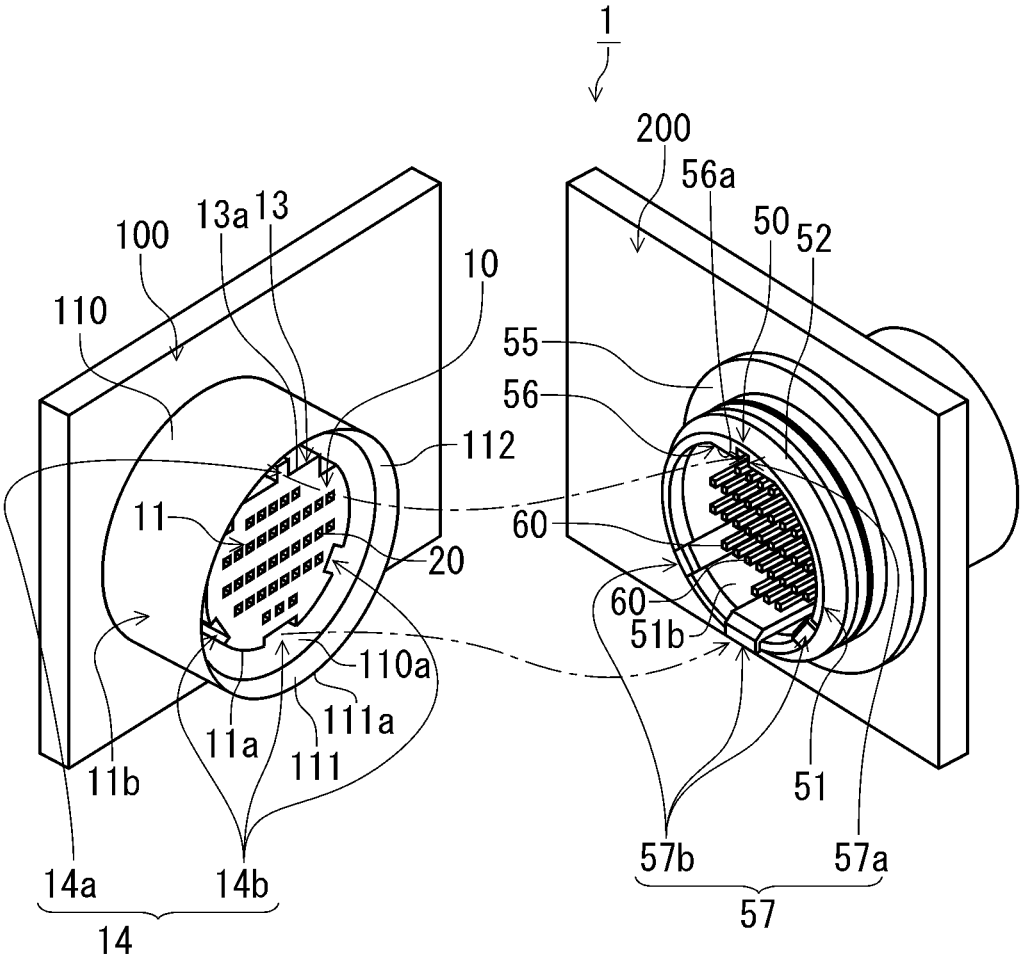
FIG. 10 is a diagram depicting a modified example made to the connector unit according to the embodiment of the disclosure.

For example, as shown in FIG. 10, the groove portion 14*b* of the cylinder side rotation restricting portion 14 and the projecting portion 57*b* of the tube side rotation restricting portion 57 each may be provided in a plurality of locations. In this way, when the number of locations where the groove portion 14*b* or the projecting portion 57*b* is increased, the relative rotation of the male connector 10 and the female connector 50 is made more difficult to occur. Namely, the locations where the cylinder side rotation restricting portion 14 and the tube side rotation restricting portion 57 may be set as required in consideration of assembling properties.

Thus, while the disclosure made by the inventor has been described specifically based on the embodiment of the disclosure that has been described above, the disclosure is not limited to the embodiment and hence can be modified variously without departing from the spirit and scope thereof.

The connector unit which prevents the damage of terminals when a male connector is fitted in a female connector can be provided.

What is claimed is:

1. A connector unit comprising:

a male connector that includes a hood portion and a cylindrical proximal portion in which a female terminal is accommodated; and a female connector that includes a tubular proximal portion in which a male terminal is held, wherein the female terminal and the male terminal are connected together and the hood portion of the male connector surrounds an outer circumferential surface of the tubular proximal portion of the female connector when the cylindrical proximal portion is fitted in the tubular proximal portion, and the hood portion surrounds an outer circumferential surface of the cylindrical proximal portion when the female terminal and the male terminal are not connected together;

wherein the cylindrical proximal portion has:

a cylinder side marking portion including a flat surface which is formed on a part of an outer circumferential surface of the cylindrical proximal portion, the flat surface is perpendicular to a radial direction of the cylindrical proximal portion; and a cylinder side rotation restricting portion including a groove portion or a projecting portion formed on the outer circumferential surface of the cylindrical proximal portion; and wherein the tubular proximal portion has:

a tube side marking portion including a flat surface which is formed on an inner surface circumferential surface of the tubular proximal portion so as to corresponds to the flat surface of the cylinder side marking portion;

a tube side rotation restricting portion including a projecting portion which is projected from the inner circumferential surface so as to fit in the groove portion of the cylinder side rotation restricting portion or a groove portion which is formed in the inner circumferential surface so that the projecting portion of the cylinder side rotation restricting portion is fitted therein;

the groove portion of the tube side rotation restricting portion is formed in the flat surface of the tube side marking portion;

wherein the projecting portion of the cylinder side rotation restricting portion is formed on the flat surface of the cylinder side marking portion; and wherein the projecting portion of the cylinder side rotation restricting portion is arranged in a gap between the outer circumferential surface of the cylindrical proximal portion and the hood portion.

2. The connector unit according to claim 1, wherein the cylindrical proximal portion has more than one cylinder side rotation restricting portion, and the more than one cylinder side rotation restricting are provided individually in a plurality of locations on the outer circumferential surface of the cylindrical proximal portion;

wherein the tubular proximal portion has more than one tube side rotation restricting portion, and the more than one tube side rotation restricting portion are provided individually in a plurality of locations on the inner circumferential surface of the tubular proximal portion so as to fit in the more than one cylinder side rotation restricting portion respectively;

wherein each cylinder side rotation restricting portion includes a groove portion or a projecting portion formed on the outer circumferential surface of the cylindrical proximal portion; and wherein each tube side rotation restricting portion includes a projecting portion which is projected from the inner circumferential surface so as to fit in the groove portion of cylinder side rotation restricting portion or a groove portion which is formed in the inner circumferential surface so that the projecting portion of cylinder side rotation restricting portion is fitted therein.

* * * * *